US005257076A

United States Patent [19]

Nishimura et al.

[11] Patent Number: 5,257,076

[45] Date of Patent: Oct. 26, 1993

[54] TONER FEEDING DEVICE CAPABLE OF SIGNALLING NEED TO REPLENISH TONER

[75] Inventors: Toshinori Nishimura, Hirakata; Hidekazu Sakagami, Goze; Hiromi Sakata, Suita, all of Japan

[73] Assignee: Mita Industrial Co., Ltd., Chuo, Japan

[21] Appl. No.: 885,377

[22] Filed: May 19, 1992

[30] Foreign Application Priority Data

May 20, 1991 [JP] Japan ..... 3-142706

[51] Int. Cl.[5] ..... G03G 15/08; G03G 21/00

[52] U.S. Cl. ..... 355/246; 355/260

[58] Field of Search ..... 355/245, 246, 259, 260; 222/DIG. 1

[56] References Cited

U.S. PATENT DOCUMENTS

| | | | |
|---|---|---|---|
| 4,338,019 | 7/1982 | Terashima et al. | 355/246 |
| 4,803,513 | 2/1989 | Nishise et al. | 355/245 X |
| 4,868,599 | 9/1989 | Niki | 355/260 |
| 4,952,976 | 8/1990 | Katoh et al. | 355/246 X |
| 5,008,708 | 4/1991 | Enoguchi et al. | 355/259 |
| 5,031,001 | 7/1991 | Kusumoto | 355/298 |
| 5,124,751 | 6/1992 | Fukui et al. | 355/246 |

*Primary Examiner*—Fred L. Braun
*Attorney, Agent, or Firm*—Antonelli, Terry Stout & Kraus

[57] ABSTRACT

A toner conveyor disposed in a housing includes an upstream-side toner conveyor and a downstream-side toner conveyor. A toner amount detector is disposed to detect whether the amount of toner in the downstream portion of the housing is greater than a predetermined amount or not, and the upstream-side toner conveyor is not operated when the amount of toner is greater than the predetermined amount in the downstream portion of the housing. A toner replenishment signal is produced when the amount of toner is not greater than the predetermined amount in the downstream portion of the housing despite the downstream-side toner conveying means being operated for more than a predetermined period of time. The toner amount detector can be a plate which rests on top of the toner and pivots up and down as the toner level changes, with a magnet on the plate detected by a suitable detector. Alternatively, the toner amount detector can be a member which moves up and down on top of the toner as the toner level changes, and a photodetector which is activated when the member is at a low level.

20 Claims, 11 Drawing Sheets

TONER FEEDING DEVICE CAPABLE OF SIGNALLING NEED TO REPLENISH TONER

FIELD OF THE INVENTION

The present invention relates to a toner feeding device which can be applied to an electrostatic latent image developing apparatus which is mounted on an electrostatic copying machine, a laser beam printing machine or the like.

DESCRIPTION OF THE PRIOR ART

In an electrostatic latent image developing device mounted on an electrostatic copying machine or a laser beam printing machine, toner is applied to an electrostatic latent image to develop a toner image. Therefore the toner is consumed as the execution of developing proceeds. The developing device is usually equipped with a toner feeding device to feed toner to the developing device as need arises.

A typical toner feeding device has a housing in which a toner container is disposed at an upstream end and a toner sending means is disposed at a downstream end. In the housing there is disposed a toner conveying means which conveys the toner discharged to the upstream portion of the housing from the toner container to the downstream portion of the housing. The toner sending means disposed at the downstream end of the housing sends the toner to the developing means, as required. From the standpoint of designing as a whole the electrostatic copying machine or the laser beam printing machine, it often becomes necessary to extend the housing to a relatively long extent from the upstream end where the toner container is disposed to the downstream end where the toner sending means is disposed. In such a case, a plurality of the toner conveying means must be provided in the housing. Each toner conveying means is composed for example, of a rotary member having a conveying rod portion that extends substantially in parallel with the center axis of rotation. When the rotary member is rotated in a predetermined direction, toner is conveyed by the action of the conveying rod portion. The toner sending means and the toner conveying means are connected to a common drive means and both of them are actuated when the toner is to be sent to the developing device.

Here, the conventional toner feeding device of the form described above involves the following problems that must be solved.

First, the plurality of toner conveying means disposed in the housing are all started or stopped simultaneously, and an excess amount of toner is usually conveyed from the upstream portion to the downstream portion. Therefore, the toner tends to be compressed and agglomerated at the downstream portion of the housing, or an excess of load acts upon the toner conveying means disposed at the downstream portion and further acts upon the drive means. The above problems can be solved if the amount of toner conveyed by the toner conveying means corresponds fully precisely to the amount of toner sent by the toner sending means. This, however, is virtually impossible, or quite difficult. If the amount of toner conveyed by the toner conveying means is set to be smaller than the amount of toner sent by the toner sending means, toner is not fed in sufficient amounts to the developing device. Usually, therefore, the amount of toner conveyed by the toner conveying means is set to be slightly greater than the amount of toner sent by the toner sending means.

Second, when the amount of toner in the toner feeding device becomes small as a result of its consumption, it becomes necessary to replenish the toner container disposed at the upstream end of the housing with toner, or to renew the toner container itself. Therefore, the conventional toner feeding device is provided with a special detector means for detecting the toner in the toner container. This is one of causes of difficulty in reducing the manufacturing cost.

Third, it is desired to detect the amount of toner that exists at the downstream portion of the housing in relation to solving the above first and second problems, or separately therefrom. However, there is not available a simple and low cost detector which is capable of detecting the amount of toner at the downstream portion of the housing without posing such problems as scattering of toner from the housing.

SUMMARY OF THE INVENTION

It is, therefore, a first object of the present invention to provide a novel and improved toner feeding device which reliably prevents the amount of toner from becoming too small or too large at the downstream portion of the housing, and thus solves the above first problem inherent in conventional toner feeding devices.

It is a second object of the present invention to provide a novel and improved toner feeding device which detects the need to of replenish the toner feeding device with toner based upon the amount of toner detected at the downstream portion of the housing in relation to or separately from solving the above first technical problem, without the need to detect the amount of toner in the toner container.

It is a third object of the present invention to provide a novel and improved toner feeding device equipped with a toner amount detector means which is capable of detecting the amount of toner as required at the downstream portion of the housing without posing a problem such as scattering of toner from the housing.

Other objects of the present invention will become apparent from the following detailed description of an embodiment of a toner feeding device constructed according to the present invention, by reference to the accompanying drawings.

In order to achieve the above first object according to the present invention, there is provided a toner feeding device comprising:

a housing, a toner container disposed at the upstream end of said housing, a toner sending means disposed at the downstream end of said housing, a toner conveying means for conveying the toner discharged from said toner container toward said toner sending means through said housing, a drive means for driving said toner conveying means, a control means for controlling the energization and de-energization of said drive means, and said toner conveying means including at least one upstream-side toner conveying means disposed at the upstream portion of said housing and at least one downstream-side toner conveying means disposed at the downstream portion of said housing; wherein said drive means includes an upstream side drive means for driving said upstream side toner conveying means and a downstream side drive means for driving said downstream side toner conveying means:

a toner amount detector means is disposed to detect the amount of toner that exists at the downstream portion of said housing; and said control means prevents energization of said upstream side drive means when the amount of toner detected by said toner amount detector means is greater than a predetermined amount.

In order to achieve the above second object according to the present invention, furthermore, there is provided a toner feeding device comprising:

a housing, a toner container disposed at the upstream end of said housing, a toner sending means disposed at the downstream end of said housing, a toner conveying means for conveying the toner discharged from said toner container toward said toner sending means through said housing, a drive means for driving said toner conveying means, a control means for controlling the energization and de-energization of said drive means, and said toner conveying means including at least one upstream-side toner conveying means disposed at the upstream portion of said housing and at least one downstream-side toner conveying means disposed at the downstream portion of said housing; wherein a toner amount detector means is disposed to detect the amount of toner that exists at the downstream portion of said housing; and said control means gives a toner replenishment signal when the amount of toner detected by said toner amount detector means is smaller than a predetermined amount irrespective of when said upstream side toner conveying means is operated for more than a predetermined period of time.

Moreover, in order to achieve the above third object according to the present invention, there is provided a toner feeding device comprising:

a housing, a toner container disposed at the upstream end of said housing, a toner sending means disposed at the downstream end of said housing, a toner conveying means for conveying the toner discharged from said toner container toward said toner sending means through said housing, a drive mean for driving said toner conveying means, a control means for controlling the energization and de-energization of said drive means, and said toner conveying means including at least one upstream-side toner conveying means disposed at the upstream portion of said housing and at least one downstream-side toner conveying means disposed at the downstream portion of said housing; wherein a toner amount detector means is disposed to detect the amount of toner that exists at the downstream portion of said housing; and said toner amount detector means is rotatably mounted inside the downstream portion of said housing and is constituted by a rotary plate that comes in contact with the upper surface of the toner existing at the downstream portion of said housing and a detector which detects said rotary plate.

Similarly, in order to achieve the above third object according to the present invention, there is provided a toner feeding device comprising:

a housing, a toner container disposed at the upstream end of said housing, a toner sending means disposed at the downstream end of said housing;

a toner conveying means for conveying the toner discharged from said toner container toward said toner sending means through said housing, a drive means for driving said toner conveying means, a control means for controlling the energization and de-energization of said drive means, and said toner conveying means including at least one upstream-side toner conveying means disposed at the upstream portion of said housing and at least one downstream-side toner conveying means disposed at the downstream portion in said housing; wherein a toner amount detector means is disposed to detect the amount of toner that exists at the downstream portion of said housing, said toner amount detector means being allowed to ascend and descend in the downstream portion of said housing, and being constituted by an ascend/descend member that ascends or descends in accordance with the amount of toner that exists in the downstream portion of said housing and a detector which detects said ascend/descend member.

In the toner feeding device constructed according to the present invention, operation of the upstream side toner conveying means which conveys the toner from the upstream portion of the housing toward the downstream portion is controlled separately from the operation of the downstream side toner conveying means disposed at the downstream portion of the housing or separately from the operation of the toner sending means disposed at the downstream end of the housing, and the amount of toner is suitably maintained and is reliably prevented from becoming too small or too large at the downstream portion of the housing.

In the toner feeding device constructed according to the present invention, furthermore, the necessity for replenishing the toner feeding device with toner is suitably detected upon detecting that the amount of toner at the downstream portion of the housing does not exceed a predetermined amount irrespective of when the upstream side toner conveying means is operated for more than a predetermined period of time.

In the toner feeding device constructed according to the present invention, furthermore, the amount of toner at the downstream portion of the housing is suitably detected by a simply and low cost constructed toner amount detector which is disposed at the downstream portion of the housing and which includes a swing plate or an ascend/descend member, without posing a problem such as scattering of toner from the housing.

DETAILED DESCRIPTION OF PREFERRED EMBODIMENTS

A preferred embodiment of the toner feeding device constructed according to the present invention will now be described in detail with reference to the accompanying drawings.

Figure 1:
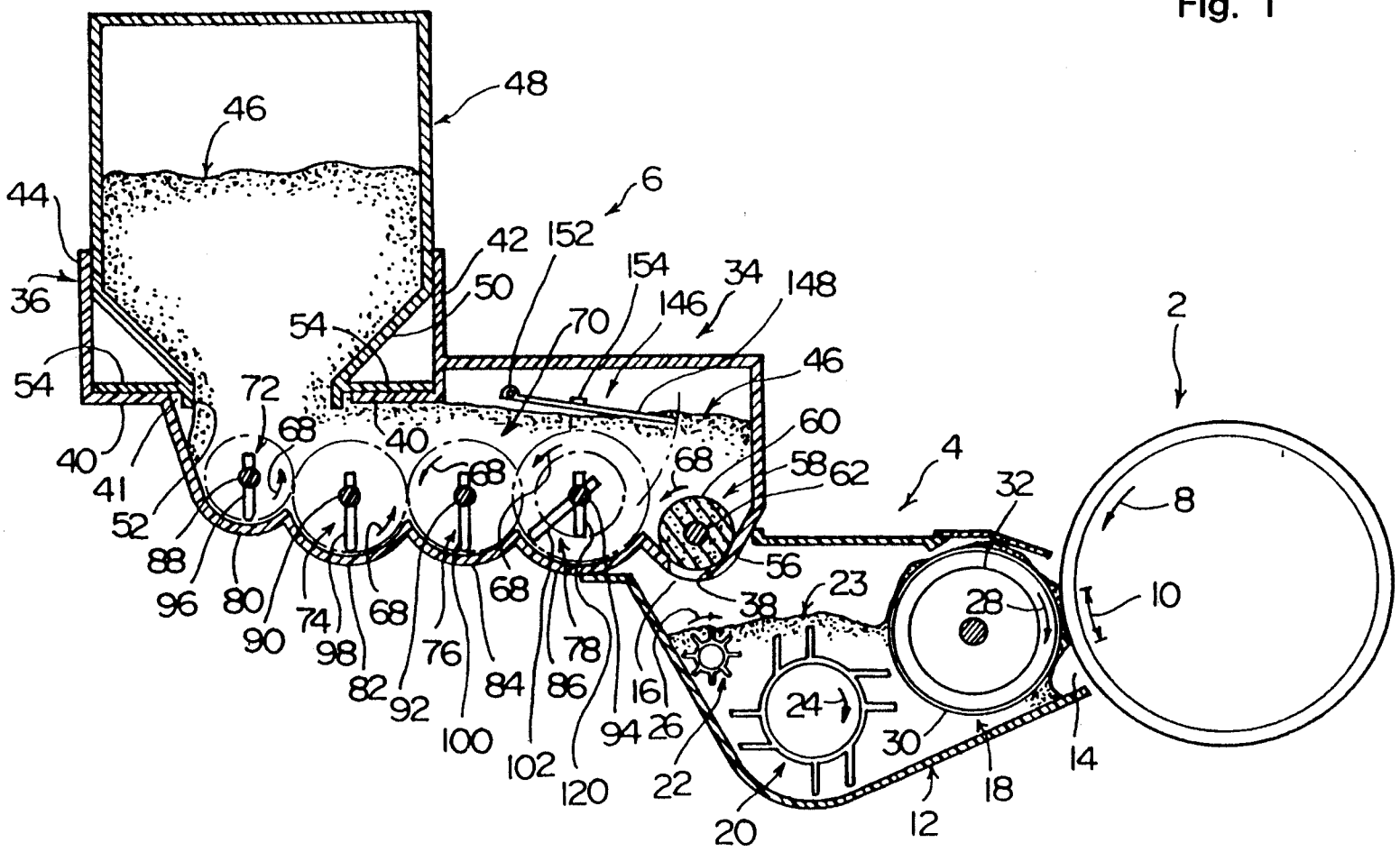
FIG. 1 is a vertical sectional view which illustrates a preferred embodiment of a toner feeding device constructed according to the present invention together with a rotary drum and a developing device.

FIG. 1 shows a preferred embodiment of the toner feeding device constructed according to the present invention that is generally designated at 6, together with a rotary drum 2 and a developing device 4.

An electrostatic photosensitive member is arranged on the peripheral surface of the rotary drum 2. An electrostatic latent image is formed on the photosensitive member on the upstream side of a developing zone 10 while the rotary drum 2 is rotated in the direction indicated by arrow 8, and toner is applied to the electrostatic latent image on the photosensitive member in the developing zone 10 by the action of the developing device 4 to develop a toner image. The toner image on the photosensitive member is transferred onto a transfer paper, which may be a common paper, on the downstream side of the developing zone 10, whereby a copy or a print is produced.

The illustrated developing device 4 is provided with a developing housing 12 which has a developing opening 14 formed in the right side surface thereof and a toner-receiving opening 16 formed at the upper left end portion thereof. In the developing housing 12 are arranged a magnetic brush mechanism 18 and agitating mechanisms 20 and 22. A developer 23 is held in the developing housing 12. The developer 23 consists of a toner and a carrier. agitating mechanisms 20 and 22 are rotated in the directions indicated by arrows 24 and 26, respectively, and constitute rotary agitating members. The agitating mechanisms 20 and 22 agitate the developer 23 in the developing housing 12, so that the toner is frictionally charged to have a predetermined polarity. The magnetic brush mechanism 18 is formed as a sleeve member 30, which is rotated in the direction indicated by arrow 28, and a stationary permanent magnet 32 disposed in the sleeve member 30. The developer 23 is magnetically held on the peripheral surface of the sleeve member 30 and is carried onto the developing zone 10 to apply toner to the electrostatic latent image formed on the photosensitive member arranged on the peripheral surface of the rotary drum 2. The toner in the developer 23 is consumed as the developing is performed; therefore, toner is fed into the developing housing 12 from the toner feeding device 6 in accordance with the consumption of toner.

The rotary drum 2 and the developing device 4 are examples of a developing device to which the toner feeding device 6 of the present invention is applied and a rotary drum on which an electrostatic latent image is formed, and may be ones well known among people skilled in the art. Therefore, the detailed description of the rotary drum 2 and developing device 4 is not included in this specification.

With further reference to FIG. 1, the toner feeding device 6 according to the present invention is provided with a housing 34 which can be made of a suitable synthetic resin. The housing 34 has a toner container-mounting portion 36 formed in the upper surface at the upstream end portion thereof and has a toner sending opening 38 formed in the lower surface at the downstream end portion thereof. More detailedly, an upper wall portion 40 is arranged extending substantially horizontally on the upper surface of the upstream end (left end) of the housing 34. In the upper wall portion 40 is formed an opening 41 that extends in the direction of width (direction perpendicular to the surface of the paper in FIG. 1). On both sides of the upper wall portion 40 are formed a pair of support walls 42 and 44 upwardly extending substantially vertically. A toner container 48 holding toner 46 is detachably mounted on the toner container-mounting portion 36 that is defined by the upper wall portion 40 and the pair of support walls 42 and 44. The toner container 48 is of a box shape that extends oblongly in the width direction, and has a funnel-shaped portion 50 formed at the lower portion thereof in the position shown in FIG. 1, with side walls that are that are downwardly slanted in the directions to gradually approach each other. A discharge port 52 is formed at the lower end of the funnel-shaped portion to extend in the width direction. A mounting flange 54 is formed at the lower end of the toner container 48 to protrude toward both sides from the discharge port 52. As shown in FIG. 1, the toner container 48 is positioned in the opening 41 of the housing 34 with its discharge port 52 being faced downwards and is mounted on the toner container-mounting portion 36 of the housing 34 by positioning the mounting flange 54 on the upstream side upper wall portion 40 of the housing 34. The pair of support walls 42 and 44 formed in the housing 34 hold main portions of both side walls of the toner container 48. The discharge port 52 of the toner container 48 is sealed with a suitable sealing member (not shown). After the toner container 48 is mounted on the housing 34 as required, the sealing member is removed to open the discharge port 52. Then, the toner 46 held in the toner container 48 is discharged into the upstream end portion (left end in FIG. 1) of the housing 34 through the discharge port 52 and the opening 41.

Figure 2:
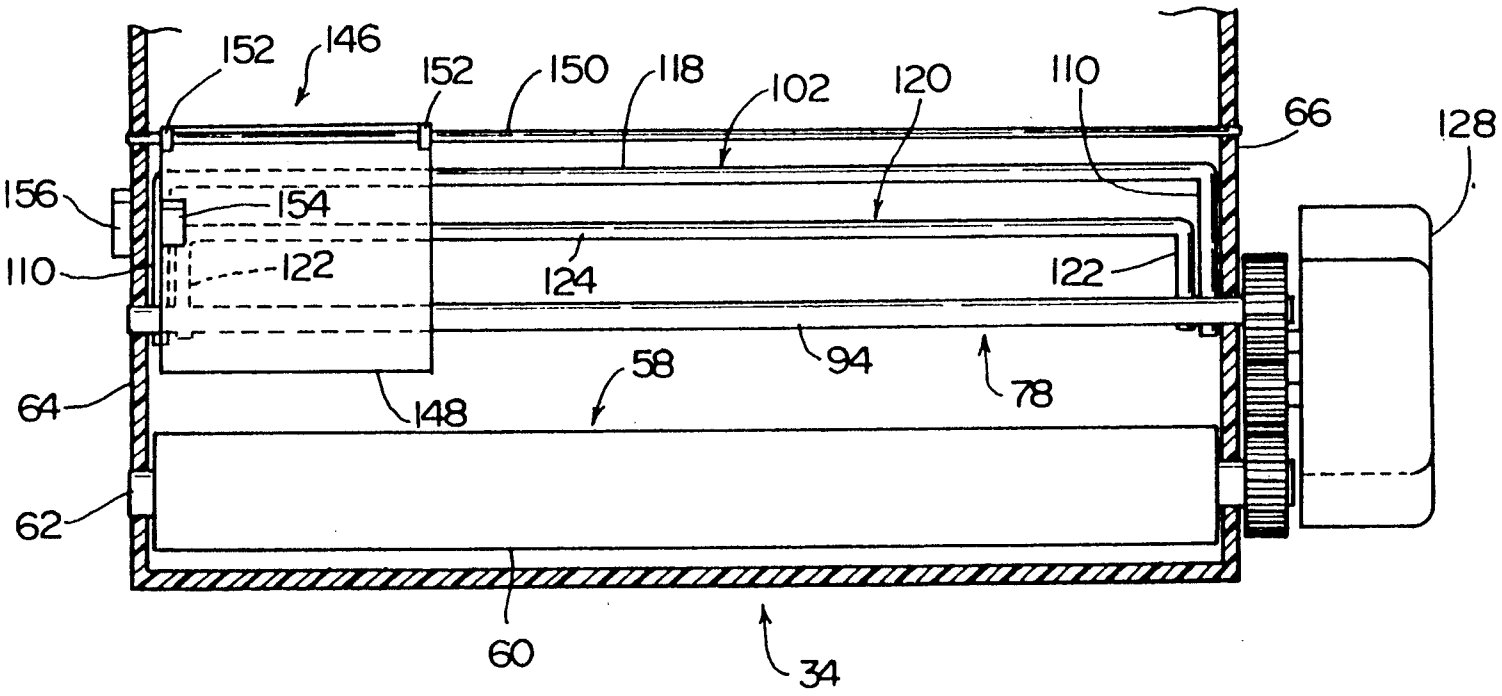
FIG. 2 is a horizontal sectional view illustrating a portion of the toner feeding device of FIG. 1.

The lower walls of the housing 34 are downwardly sloped in the directions to gradually approach each other on both sides of the toner sending opening 38 formed in the lower surface at the downstream end of the housing 34 of the toner feeding device 6, thereby to define a sending portion 56 of an inverted trapezoidal shape in cross section. A toner sending means 58 is disposed in the sending portion 56. The toner sending means 58 in the illustrated embodiment is constituted by a sending roller 60 that extends in the width direction (direction perpendicular to the surface of the paper in FIG. 1). With reference to FIG. 2 together with FIG. 1, a sending roller 60, which can be made of a sponge, has a rotary shaft 62 which extends substantially horizontally in the width direction and which is rotatably mounted between a front wall 64 and a rear wall 66 of the housing 34. As will be described later, the sending roller 60 is selectively rotated in the direction indicated by arrow 68 (FIG. 1) and, thus, the toner 46 is sent into the developing housing 12 of the developing device 4 through the toner sending opening 38 of the housing 34.

In the housing 34 of the toner feeding device 6 is disposed a toner conveying means, that is generally designated at 70, in order to convey the toner 46 discharged onto the upstream end of the housing 34 from the toner container 48 toward the toner sending means 58. The toner conveying means 70 of the illustrated embodiment includes two upstream-side toner conveying means 72 and 74, as well as two downstream-side toner conveying means 76 and 78. In the lower wall of the housing 34 are formed four arcuate portions 80, 82, 84 and 86 that downwardly swell and correspond to the upstream-side toner conveying means 72, 74 and the downstream-side toner conveying means 76, 78. With reference to FIG. 2 together with FIG. 1 the upstream-side toner conveying devices 72, 74 and the downstream-side toner conveying devices 76, 78 include horizontal rotary shafts 88, 90, 92 and 94 that are rotatably mounted between the front wall 64 and the rear wall 66 of the housing 34. Rotary members 96, 98, 100 and 102 are secured the rotary shafts 88, 90, 92 and 94, respectively. As shown in FIG. 2, the rotary member 102 has coupling portions 110 that extend in the radial direction from both ends of the rotary shaft 94 and a conveying rod portion 118 that extends substantially in parallel with the rotary shaft 94 (i.e., substantially horizontally) between the coupling portions 110. Similarly, other rotary members 96. 98 and 100 have coupling portions that extend in the radial direction from both ends of their respective rotary shafts 88 90 and 92, and conveying rod portions that extend substantially in parallel with the rotary shafts 88, 90 and 92 between the coupling portions. As will be described later, the upstream-side toner conveying means 72, 74 and the downstream-side toner conveying means 76, 78 are selectively rotated in the directions indicated by arrows 68. The conveying rod portions of the rotary members 96, 98, 100 and 102 move along the arcuate portions 80, 82, 84 and 86 in the lower wall of the housing 34 in order to move the toner 46 in the housing 34 from the left toward the right in FIG. 1. The downstream-side toner conveying means 78 is further provided with an auxiliary rotary member 120 which has coupling portions 122 that extend in the radial direction from the rotary shaft 94 axially inward of the coupling portion 110 of the rotary member 102 and an auxiliary rod portion 124 that extends on the inside in the radial direction between the above coupling portions 122 in parallel with the conveying rod portion 118 of the rotary member 102. As will be clearly understood from FIG. 1, the auxiliary rotary member 120 is secured to the common rotary shaft 94 and is angularly supported by a predetermined angle, which may be about 50 degrees in the direction of rotation indicated by arrow 68, with respect to the rotary member 102. Therefore, the auxiliary rotary member 120 is rotated together with the rotary member 102 in the direction indicated by arrow 68.

Figure 3:
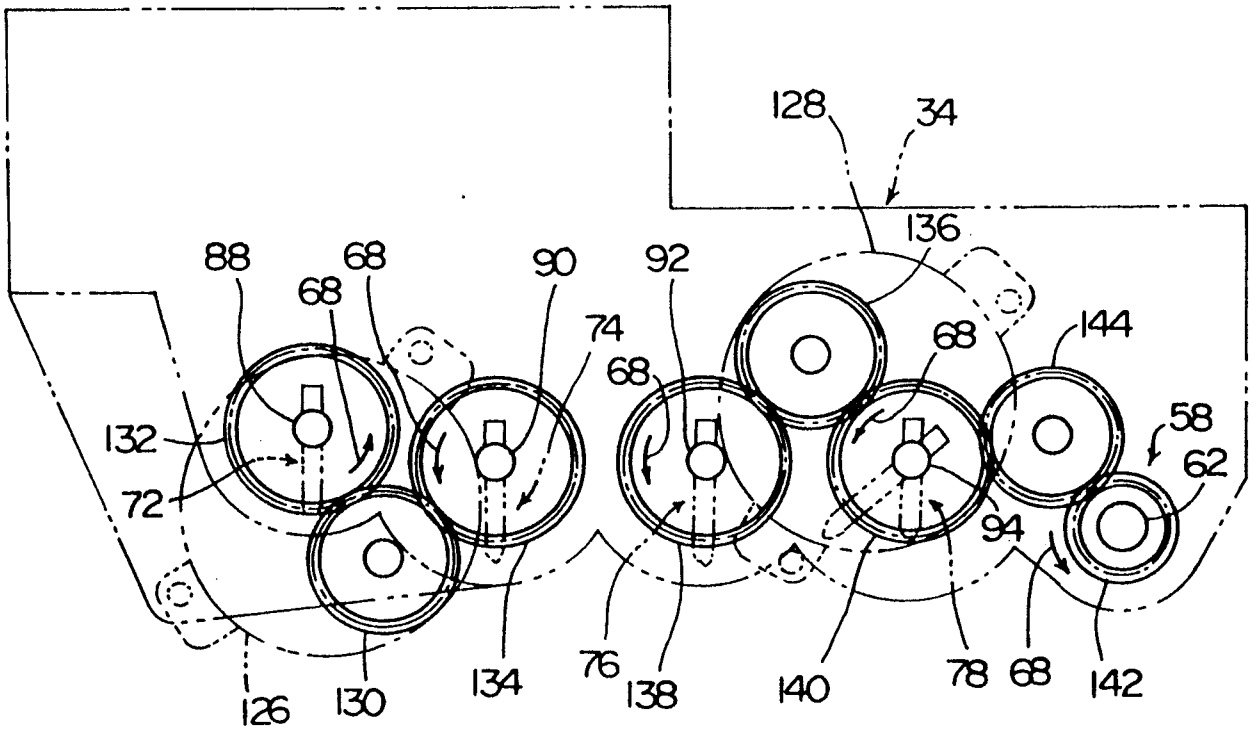
FIG. 3 is a schematic diagram illustrating a drive system in the toner feeding device of FIG. 1.

With reference to FIG. 3 together with FIGS. 1 and 2 two drive means, i.e.. an upstream-side drive means 126 and a downstream-side drive means 128 are arranged on the outer surface (back) of the rear wall 66 of the housing 34. An output gear 130 is fastened to the output shaft of the upstream-side drive means 126, which may be an electric motor. The rotary shafts 88 and 90 of the upstream-side toner conveying means 72 and 74 protrude rearwardly penetrating through the rear wall 66, and input gears 132 and 134 are secured to the protruded ends. As clearly shown in FIG. 3, furthermore, the output gear 130 engages the input gears 132 and 134. When the upstream-side drive means 126 is energized, therefore, the upstream-side toner conveying means 72 and 74 are rotated in the directions indicated by arrow 68. An output gear 136 is secured to the output shaft of the downstream-side drive means 128 which may similarly be an electric motor. On the other hand, the rotary shafts 92 and 94 of the downstream-side toner conveying means 76 and 78 protrude rearwardly penetrating through the rear wall 66, and input gears 138 and 140 are secured to the protruded ends thereof. Moreover, the rotary shaft 62 of the toner sending means 58 rearwardly protrudes penetrating through the rear wall 66, and an input gear 142 is secured to the protruded end thereof. The output gear, 136 of the downstream-side drive means 128 engages input gears 138 and 140. In addition, the input gear 140 is engaged with the input gear 142 via a transmission gear 144. When the downstream-side drive means 128 is energized, therefore, the downstream side toner conveying devices 76 and 78 are rotated in the direction indicated by arrow 68, and the toner sending means 58 is rotated in the direction indicated by arrow 68.

With reference to FIGS. 1 and 2, a toner amount detector means 146 is disposed in the toner feeding device 6 to detect the amount of toner that is present at the downstream portion of the housing 34. The toner amount detector means 146 in the illustrated embodiment includes a rotary plate 148. A support shaft 150 is mounted between the front wall 64 and the rear wall 66 of the housing 34. Upright mounting pieces 152 are formed on both sides at the base end of a swing plate 148 as a unitary structure. The support shaft 150 is inserted through the mounting pieces 152, and the swing plate 148 is swingably mounted at the front end of the support shaft 150. A permanent magnet 154 is fastened to the front end of the swing plate 148, i.e. the end adjacent the front end of the housing 34. A detector 156 in the form of a reed switch is secured at a predetermined position on the outer surface (front surface) of front wall 64 of the housing 34 to detect a permanent magnet 154 of the swing plate 148.

Figure 4:
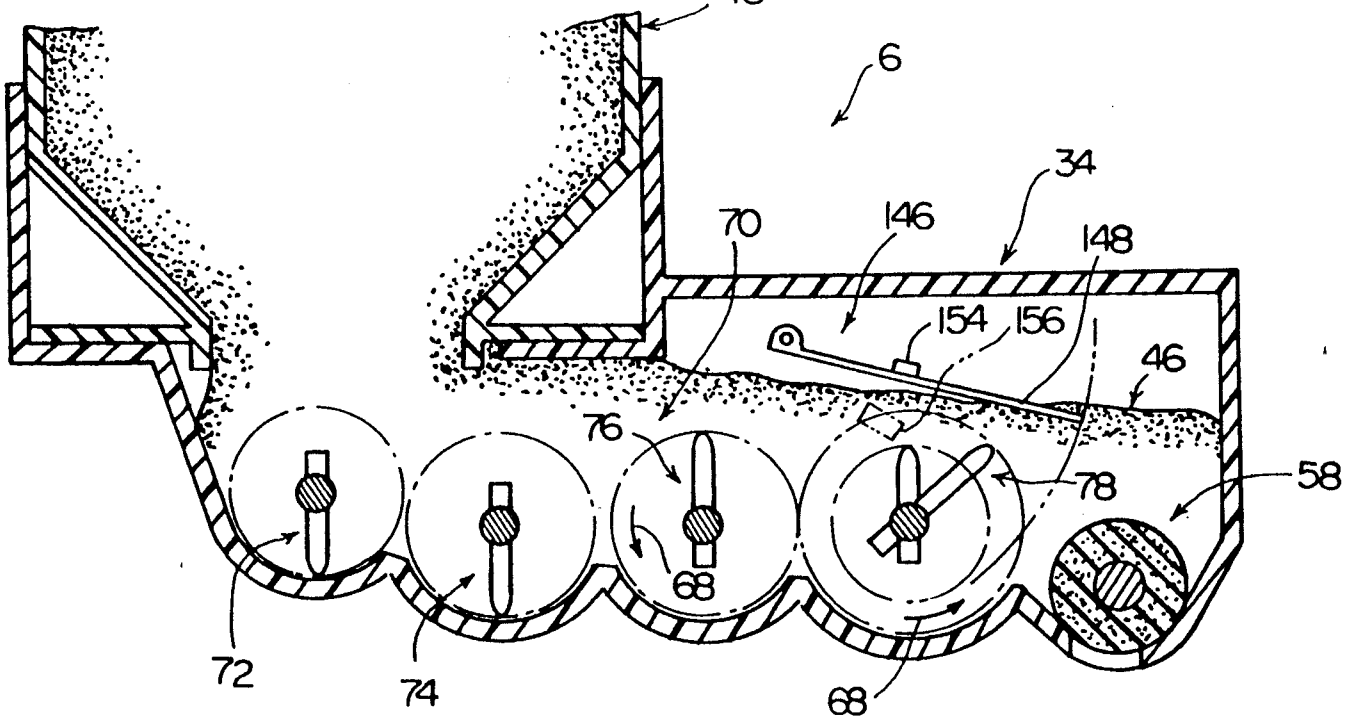
FIG. 4 is a vertical sectional view illustrating the operation of a toner amount detector means in the toner feeding device of FIG. 1 in the case where toner exists in an amount greater than a predetermined amount in the downstream portion of the housing.
Figure 5:
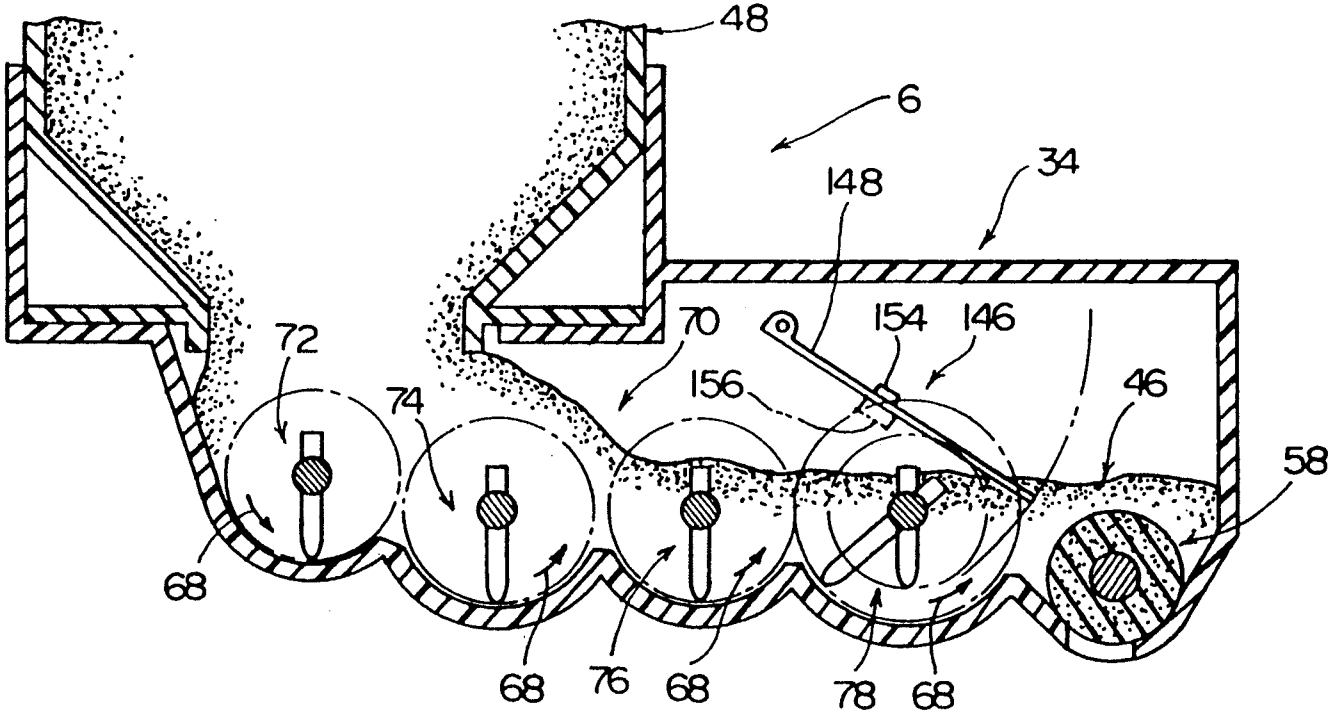
FIG. 5 is a vertical sectional view illustrating the operation of the toner amount detector means in the toner feeding device of FIG. 1 in the case where the toner does not exist in an amount greater than a predetermined amount in the downstream portion of the housing.

When the toner 46 exists in a sufficiently large amount in the downstream portion of the housing 34 as shown in FIG. 4, the free end of the swing plate 148 comes in contact with the upper surface of the toner 46, whereby the swing plate 148 is maintained at a relatively high position, and the detector 156 does not detect the permanent magnet 154. When the amount of toner 46 becomes low in the downstream portion of the housing 34, as shown in FIG. 5, the swing plate 148 pivots in the clockwise direction, and the detector 156 detects the permanent magnet 154. As will be easily understood by reference to FIG. 5, when the swing plate 148 is lowered with the reduction in the amount of the toner 46 in the downstream portion of the housing 34, the swing plate 148 protrudes into the loci of rotation of the conveying rod portion 118 of rotary member 102 and the auxiliary rod portion 124 of auxiliary rotary member 120 in the downstream-side toner conveying means 78. Therefore, when the downstream-side toner conveying means 78 is rotated in the direction indicated by arrow 68, the auxiliary rod portion 124 of the auxiliary rotary member 120 first acts on the swing plate 148 to pivot it in the counterclockwise direction to raise it and then, the conveying rod portion 118 of the rotary member 102 acts on the swing plate 148 to further pivots it in the counterclockwise direction to raise it. Then, as the rotary member 102 discontinues to act thereon, the swing plate 148 again turns in the clockwise direction due to its own weight, and is lowered to the illustrated position i.e., to a position at which the detector 156 detects the permanent magnet 154. As the amount of toner 46 becomes smaller than a predetermined amount at the downstream portion of the housing 34, therefore, the detector 156 periodically detects the permanent magnet 154 while the downstream-side toner conveying means 74 is rotated in the direction indicated by arrow 68. The swing plate 148 is reciprocatingly pivoted in the counterclockwise direction and the clockwise direction in accordance with the motion of the downstream-side toner conveying means 78. Thus, the swing plate 148 is completely prevented from occurrence of trouble of pivoting such as blocking of pivoting that might occur when the toner 46 is clogged between the mounting pieces 152 of the swing plate 148 and the support shaft 150. Even when there is sufficient toner 46 in the downstream portion of the housing 34 as shown in FIG. 4, the upper surface of the toner 46 rises or lowers periodically due to by the rotation of the downstream-side toner conveying means 78 in the direction indicated by arrow 68, whereby the swing plate 148 is reciprocatingly pivoted to some extent and is reliably prevented from defectively pivoting.

In the illustrated embodiment, furthermore, attention should further be given to the following fact. When the downstream-side toner conveying means 78 is not provided with the auxiliary rotary member 120, the swing plate 148 does not pivot up until the conveying rod portion 118 of the rotary member 102 acts directly on the swing plate 148. In this case, the swing plate 148 interferes with the toner 46 that is moved toward the toner sending means 58 by the action of the conveying rod portion 118 of the rotary member 102, and the toner 46 is pressed onto the swing plate 148 i.e., smooth Conveying of the toner 46 sending means 58 and the toner tends to be compressed and agglomerated. In the illustrated embodiment in which the downstream side toner conveying means 78 is provided with the auxiliary rotary member 120, on the other hand, the auxiliary rod portion 124 of the auxiliary rotary, member 120 acts on the swing plate 148 to pivot it up before the rotary member 102 acts on the swing plate 148. This helps sufficiently maintain a path along which the toner 46 moves toward the toner sending means 58, and hence, the toner 46 is allowed to move very smoothly toward the toner sending means 58 by the action of the conveying rod portion 118 of the rotary member 102.

Described below are the action operation of the above-mentioned toner feeding device 6 and modes of operation for controlling the upstream-side toner conveying means 72, 74, downstream-side toner conveying means 76, 78, and toner sending means 58 by energizing and de-energizing the upstream-side drive means 126 and the downstream-side drive means 128.

Figure 6:
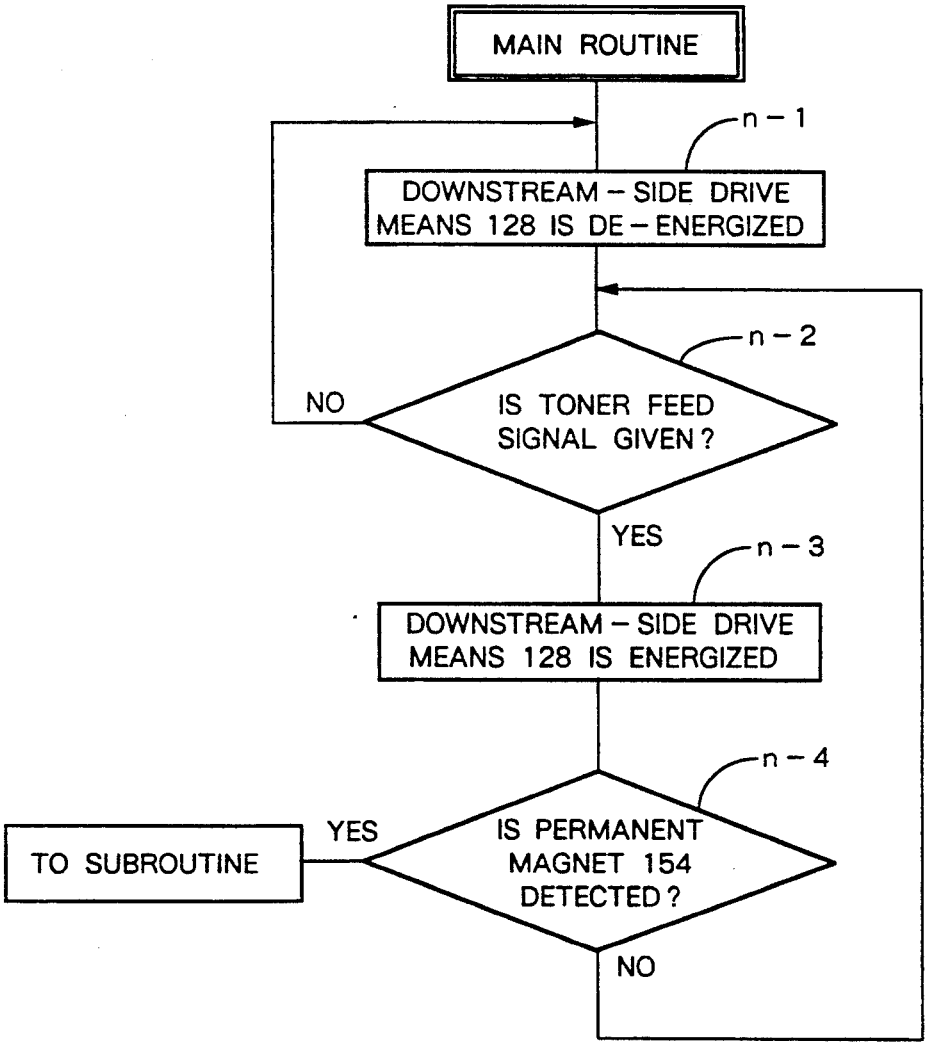
FIG. 6 is a flow chart illustrating a main routine in the operation mode of the toner feeding device of FIG. 1.

Energization and de-energization of the upstream-side drive means 126 and the downstream-side drive means 128 of the toner feeding device 6 can be controlled by a control means (not shown) that can be constituted by a microprocessor. Reference is made to a flow chart of FIG. 6 together with FIG. 1. When the downstream-side drive means 128 that is finished being energized, it is de-energized in the step n-1. Then, a step n-2 determines whether there is a toner feed signal that shows the need to feed toner 46 to the developing device 4. When the toner concentration (ratio of toner to the carrier) in the developing agent 23 in the developing housing 12 of developing device 4 becomes less than a predetermined value, a toner feed signal is produced. The toner concentration in the developing housing 12 can be detected by a suitable known detector (not shown). When the toner feed signal is not produced, the program returns to the above step n-1. When the toner feed signal is produced, the program proceeds to a step n-3 where the downstream-side drive means 128 is energized and, hence, the downstream-side toner conveying means 76 and 78 are rotated, and the toner sending means 58 is also rotated. In the downstream half portion of the housing 34 of the toner feeding device 6, therefore, toner is conveyed toward the toner sending means 58 by the action of the downstream-side toner conveying means 76 and 78, and the toner 46 is supplied from the toner feeding device 6 to the developing housing 12 of the developing device 4 by the action of the toner sending means 58. The program then proceeds to a step n-4 where it is determined whether the detector 156 in the toner amount detector means 146 detects the permanent magnet 154 mounted on the swing plate 148 or not. When toner 46 is present in an amount greater than a predetermined amount in the downstream portion of the housing 34 of toner feeding device 6, the detector 156 does not detect the permanent magnet 154. When the toner 46 is not present in an amount greater than a predetermined amount in the downstream portion of the housing 34, on the other hand, the detector 156 periodically detects the permanent magnet 154 (since the downstream-side toner conveying means 78 is rotated). When the detector 156 does not detect the permanent magnet 154, the program returns to the step n-2. The program is shifted from the main routine to a subroutine when the permanent magnet 154 is detected by the detector 156.

Figure 7:
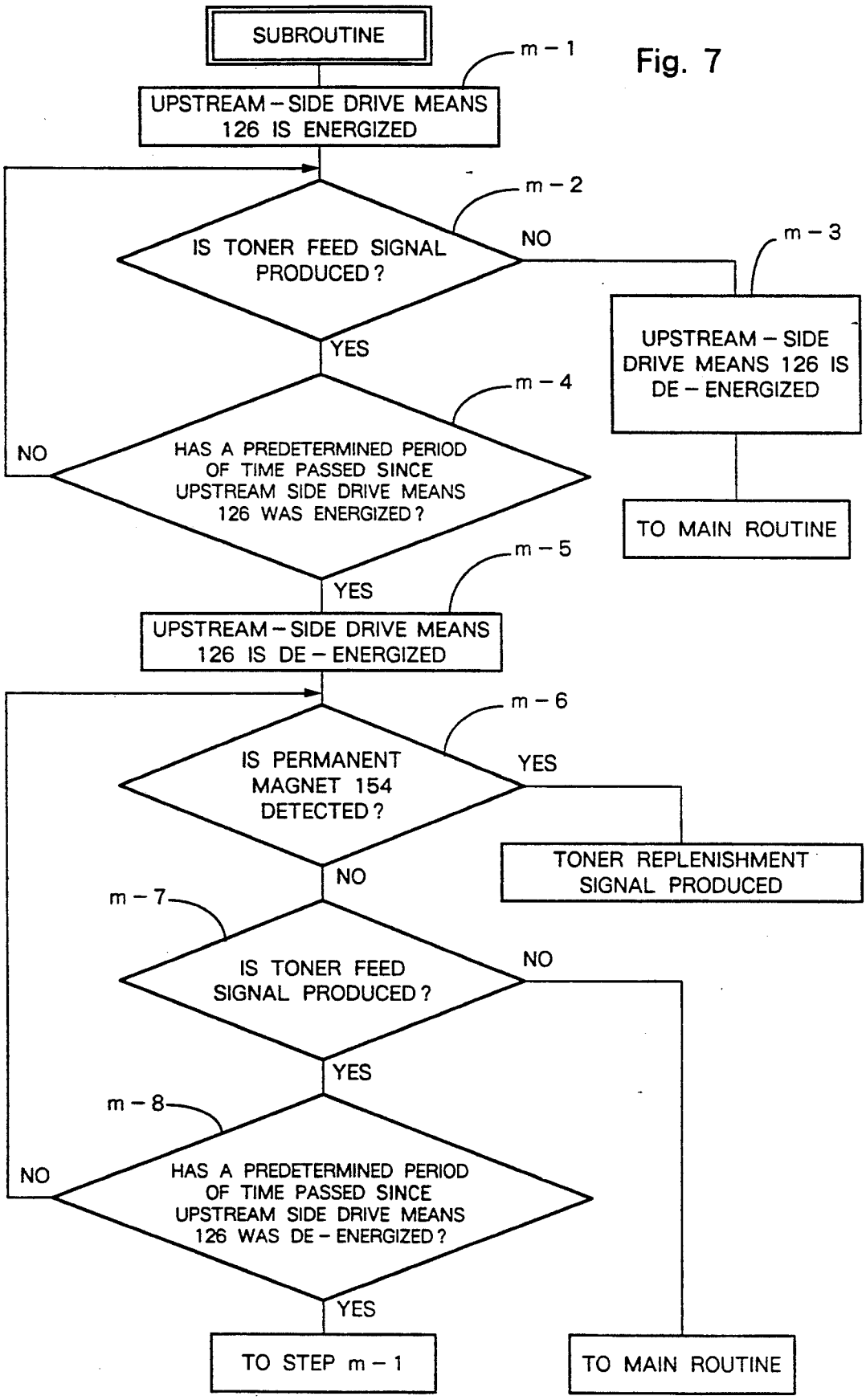
FIG. 7 is a flow chart illustrating a subroutine in the operation mode of the toner feeding device of FIG. 1.

With reference to FIG. 7, the upstream-side drive means 126 is energized at a step m-1 in the subroutine and, hence, the upstream-side toner conveying means 72 and 74 are rotated. In the upstream half portion of the housing 34 of toner feeding device 6, therefore, the toner 46 is also conveyed toward the downstream side by the action of the upstream side toner conveying means 72 and 74. The program then proceeds to a step m-2 where it is determined whether a toner feed signal is produced that shows the necessity of feeding the toner 46 to the developing device 4, like at step n-2 in the main routine. When the toner feed signal is not produced the program proceeds to a step m-3 where the upstream-side drive means 126 is de-energized and the upstream-side toner conveying means 72 and 74 stop operating. The program then returns to the main routine and accordingly, the downstream-side drive means 128 is also de-energized in the step n-1 of the main routine. Consequently, the downstream-side toner conveying means 76 and 78 stop operating, and the toner sending means 58 stop operating. When the toner feed signal is produced in the step m-2 of the subroutine, the program proceeds to step m-4 where it is determined whether a predetermined period of time has passed since energization of the upstream-side drive means 126 or not. When the predetermined period of time has not passed the program returns to the step m-2. When the predetermined period of time has passed on the other hand, the program proceeds to a step m-5 where the upstream-side drive means 126 is de-energized and the upstream-side toner conveying means 72 and 74 stop operating. The program then proceeds to a step m-6 where it is determined whether the permanent magnet 154 mounted on the swing plate 148 is detected by the detector 156 of the toner amount detector means 146 or not, like at the step n-4 of the main routine. When the permanent magnet 154 is not detected by the detector 156, the program proceeds to a step m-7 where it is determined whether there is produced a toner feed signal that shows the necessity of feeding toner 46 to the developing housing 12 of developing device. When there is given no toner feed signal, the program returns to the main routine, the downstream-side drive means 128 is de-energized at the step n-1 of the main routine, and the downstream-side toner conveying means 76 and 78 and the toner sending means 58 stops operating. When the toner feed signal is produced, the program proceeds to a step m-8 where it is determined whether a predetermined period of time has passed or not since the upstream-side drive means 126 was de-energized. When the predetermined period of time has not passed, the program returns to the step m-6 where it is determined again whether the permanent magnet 154 is detected by the detector 156 of the toner amount detector means 146. When there is insufficient toner 46 on the downstream-side of the housing 34 under the condition where the downstream-side drive means 128 is energized and the downstream-side toner conveying means 78 is rotated, the detector 156 detects the permanent magnet 154, not continuously but periodically as described above. It is therefore necessary for the detector 156 to determine whether the permanent magnet 154 is detected or not for more than a predetermined period of time (for at least more than a period of time required for the downstream-side toner conveying means 78 to make one rotation). Therefore, in the step m-8 it is determined whether a predetermined period of time has passed since the upstream side drive means 126 was de-energized, and the program returns to the step m-6 when the predetermined period of time has not passed.

When the upstream-side drive means 126 is energized for more than the predetermined period of time (step m-4). the upstream-side toner conveying means 72 and 76 are operated for more than a predetermined period of time, but the detector 156 of the toner amount detector means 146 detects the permanent magnet 154 for more than a predetermined period of time in the step m-6 (step m-8) and the toner 46 does not exist in an amount more than a predetermined amount in the downstream portion of the housing 34 it means that the toner 46 to be conveyed to the downstream portion of the housing 34 does not exist in the upstream portion of the housing 34 and hence, the toner 46 does not exist in the toner container 48. In such a case the toner replenishment signal is produced, and the toner container 48 must be replaced by a new one containing toner 46 in a required amount, or the toner container 48 must be replenished with the toner 46. When the toner container is renewed or the toner is replenished as required, the toner replenishment signal is no more given. In the toner feeding device 6 constituted according to the present invention, therefore whether the toner container 48 needs be replenished with the toner or not is detected by utilizing the detection by the detector 156 which detects whether there exists toner 46 in an amount greater than a predetermined amount in the downstream portion of the housing 34. The program returns to the step m-1 when the predetermined period of time has passed at the step m-8.

In the illustrated toner feeding device 6 constituted according to the present invention, the upstream-side toner conveying means 72 and 74 are operated only when there does not exist toner 46 in an amount greater than the predetermined amount in the downstream portion of the housing 34. When there exists toner 46 in an amount greater than the predetermined amount in the downstream portion of the housing 34 the upstream side toner conveying means 72 and 74 are not operated even when the downstream side toner conveying means 76 and 78 are operated together with the toner sending means 58. This reliably prevents the toner 46 from being compressed and agglomerated in the downstream portion of the housing 34 and further prevents the toner 46 from creating excess resistance to the downstream-side toner conveying means 76 and 78, so that no excess load is exerted on the downstream-side drive means 128.

In the illustrated embodiment, operation of the upstream-side toner conveying means 72 and 74 is controlled separately from operation of the downstream-side toner conveying means 76 and 78 by providing the upstream side drive means 126 separately from the downstream side drive means 128. If desired, the upstream side toner conveying means 72 and 74 may be drivably coupled to the downstream-side drive means 128 via a suitable clutch means, and by controlling the clutch means, operations of the upstream side toner conveying means 72 and 74 can be controlled separately from operations of the downstream-side toner conveying means 76 and 78.

Figure 8:
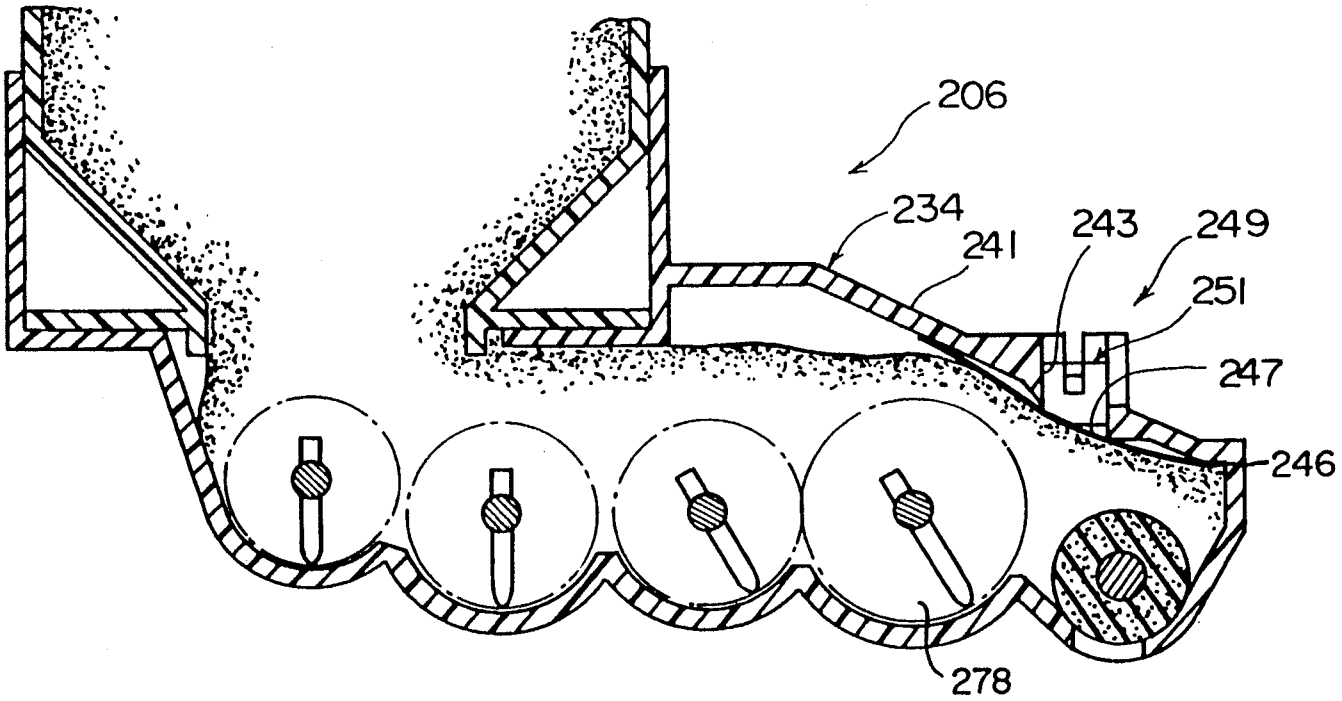
FIG. 8 is a vertical sectional view illustrating the operation of the toner amount detector means in a modified embodiment of a toner feeding device constructed according to the present invention in the where toner exists in an amount greater than a predetermined amount in the downstream portion of the housing.
Figure 9:
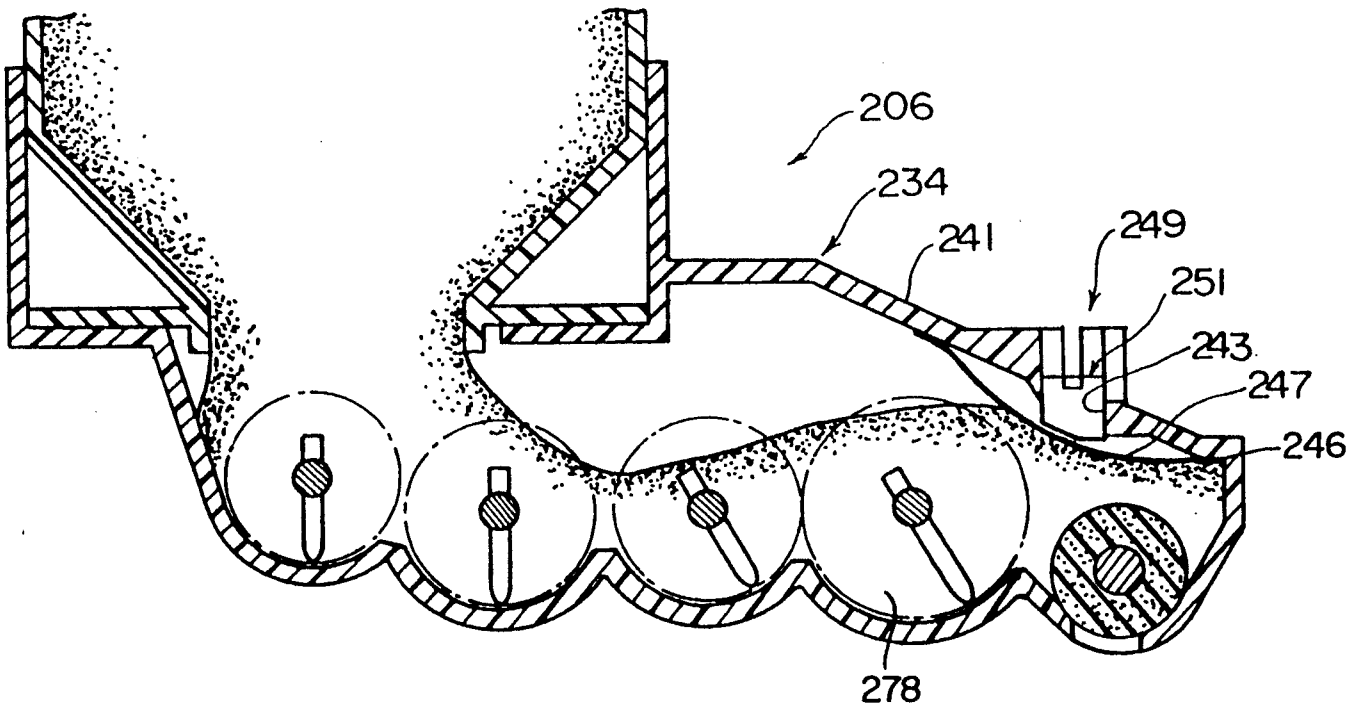
FIG. 9 is a vertical sectional view illustrating the operation of the toner amount detector means in the modified embodiment of FIG. 8 in the case where toner does not exist in an amount greater than a predetermined amount in the downstream portion of the housing.
Figure 10:
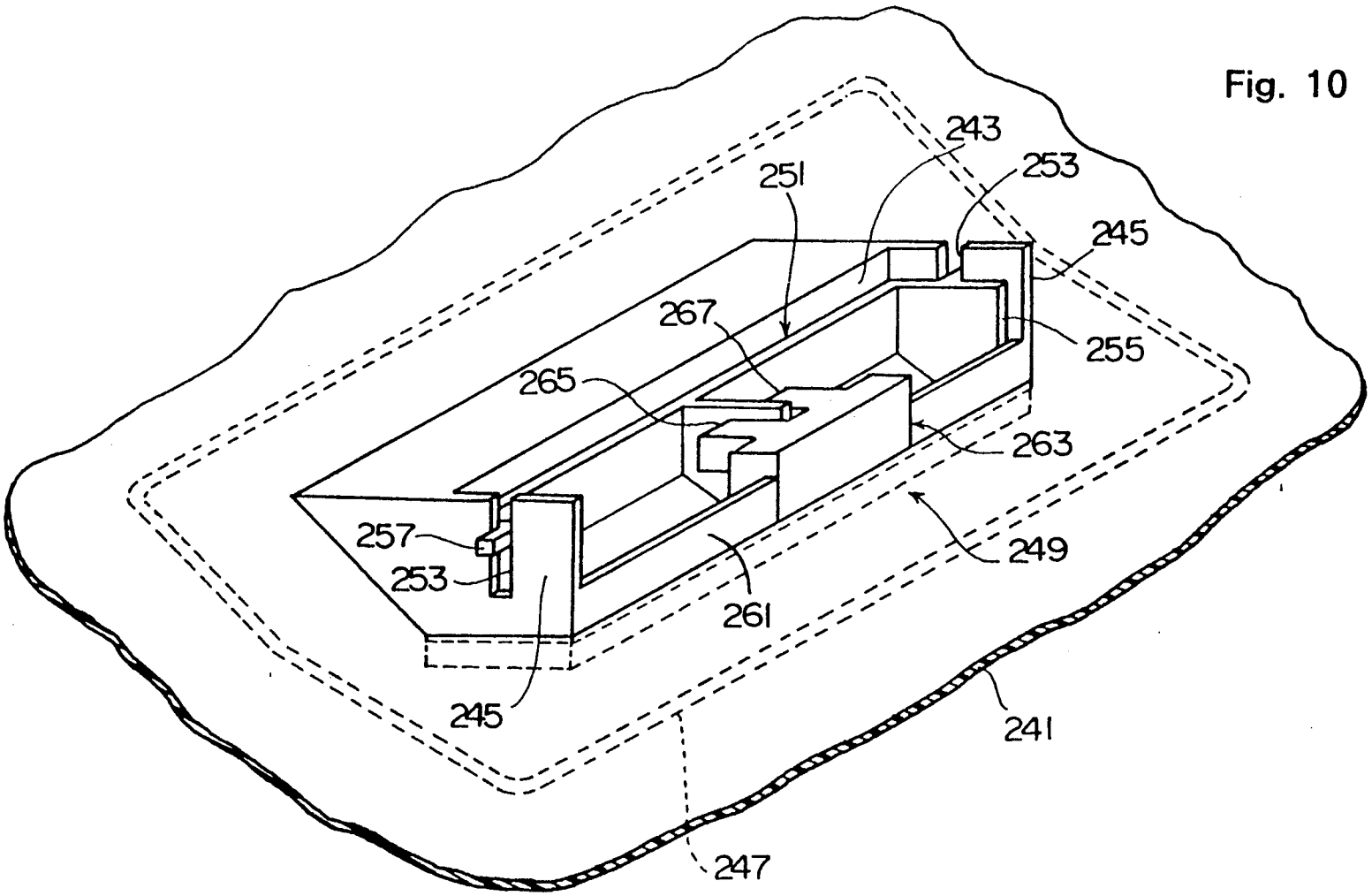
FIG. 10 is a fragmentary perspective view showing a portion of the toner amount detector means in the modified embodiment of FIG. 8.

FIGS. 8 to 13 illustrate a modified embodiment in which the toner detector means and the related constitution are modified. In this modified embodiment as shown in FIG. 10 together with FIGS. 8 and 9 an upper wall portion 241 of the downstream side in the housing 234 of toner feeding device 206 is downwardly sloped in the direction (rightwards in FIGS. 8 and 9). A detection opening 243 is formed in the upper wall portion 241 of the downstream side. As clearly shown in FIG. 10, the detection opening 243 is nearly of a rectangular shape, and a pair of upright guide walls 245 are arranged on both sides in the direction of width thereof. A separation means 247 is disposed on the inner surface (lower surface) of the upper wall portion 241 of the downstream side in the housing 234, in relation with the detection opening 243. The separation means 247 is in the form of a soft sheet member disposed on the inner surface (lower surface) of the upper wall portion 241 of the downstream side. The sheet member, which can be made of a suitable synthetic resin film, is sufficiently larger than the detection opening 243 cover the detection opening 243 on the inner surface side of the upper wall portion 241 of the downstream side and its four peripheral edges are secured to the inner surfaces of the upper wall portion 241 of the downstream side by a suitable method such as adhesion or melt-adhesion. As will be clearly understood with reference to FIGS. 8 and 9 together with FIG. 10, the downstream portion of the housing 234 is air-tightly separated by the separation means 247 into a main space located under the separation means 247, which is toner space where toner 246 is present, and a toner-free space located over the separation means 247 where the toner 246 is not present. The detection opening 243 is located in the toner-free space, and the toner 246 in the housing 234 does not scatter to the outside through the detection opening 243.

Figure 11:
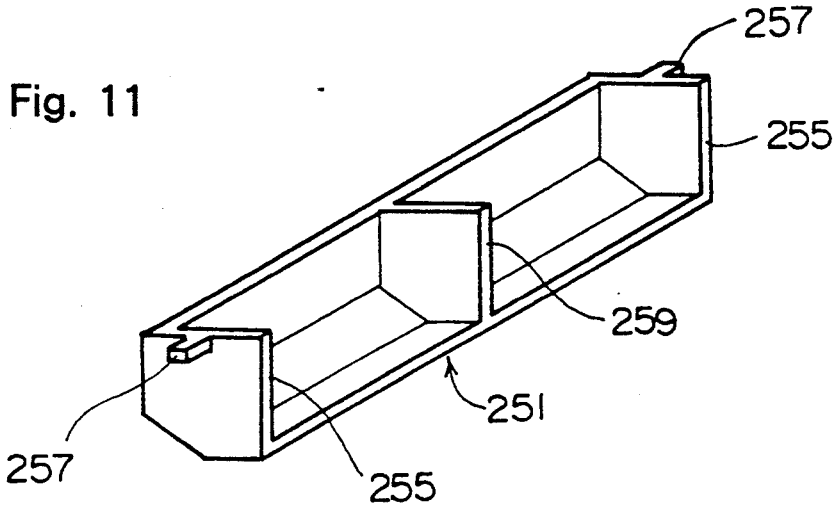
FIG. 11 is a perspective view showing an ascend/descend member in the toner amount detector means in the modified embodiment of FIG. 8.
Figure 12:
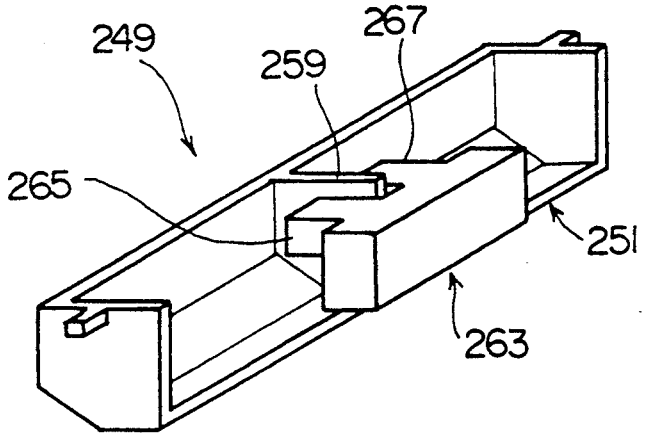
FIG. 12 is a fragmentary perspective view illustrating the operation of the toner amount detector means in the modified embodiment of FIG. 8 in the case where toner exists in an amount greater than a predetermined amount in the downstream portion of the housing modified.
Figure 13:
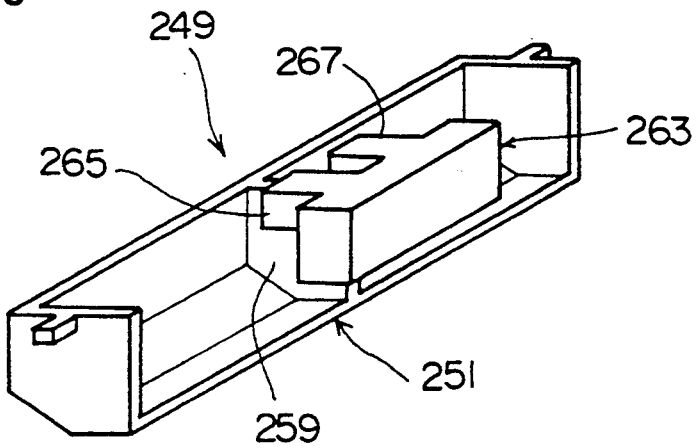
FIG. 13 is a fragmentary perspective view illustrating the operation of the toner amount detector means in the modified embodiment of FIG. 8 in the case where the toner does not exist in an amount greater than a predetermined amount in the downstream portion of the housing.

Reference is further made to FIGS. 11 to 13 together with FIGS. 8 to 10. A toner amount detector means 249 in the modified embodiment includes an ascend/descend member 251 that is fitted to the detection opening 243 so as to ascend and descend. As clearly shown in FIG. 10, a guide slot 253 is formed in each of the pair of upright guide walls 245 arranged on both sides of the detection opening 243, the guide slot 253 extending substantially vertically from the upper end in the downward direction. As clearly diagramed in FIG. 10 as well as in FIGS. 11 to 13, upright walls 255 are formed on both sides of the ascend/descend member 251 in the width direction, and a guided projection 257 is formed on each of the upright walls 255 and protrudes outwardly in the width direction. The guided projections 257 of the ascend/descend member 251 are inserted in the guide slots 253 of the upright guide walls 245, so that the ascend/descend member 251 is mounted to ascend and descend substantially in a vertical direction. As clearly diagramed in FIG. 11, an upright wall 259 to be detected is formed at a central portion of the ascend/descend member 251 in the width direction. On the other hand, on the upper wall portion 241 of the downstream side of the housing 234 is formed an upright support wall 261 (FIG. 10) that protrudes upwardly from the downstream side edge of the detection opening 243. A detector 263 that constitutes the toner amount detector means 249 in cooperation with the ascend/descend member 251 is mounted onto a central portion in the width direction of the upright support wall 259. The detector 263 by itself is formed by a widely known optical detector and has a pair of protrusions 265 and 267 that protrude toward the upstream side and are spaced in the width direction. A light-emitting element (not shown) is mounted on one of the protrusions 265 and 267 and a light-receiving element (not shown) is mounted on the other one. The upright wall 259 to be detected of the ascend/descend member 251 is positioned between the pair of protrusions 265 and 267 of the detector 263. As shown in FIGS. 8 and 12, when the toner 246 exists in an amount greater than the predetermined amount in the downstream portion of the housing 234 of the toner feeding device 206, the ascend/descend member 251 comes in contact with the upper surface of the toner 246 via the separation means 247 and is prevented from descending below a predetermined position. In this case, the upright wall 259 of the ascend/descend member 251 interrupts the optical connection between the light-emitting element and the light-receiving element of the detector 263, so that the detector 263 detects the ascend/descend member 251. As shown in FIGS. 9 and 13, on the other hand when the amount of toner 246 that exists in the downstream portion of the housing 234 of the toner feeding device 206 becomes less than the predetermined amount, the ascend/descend member 251 descends below the predetermined position. Thus the light-emitting element and light receiving element of the detector 263 are optically connected together without interruptions by the upright wall 259 of the ascend/descend member 251. The descending motion of the ascend/descend member 251 is limited, as the guided projections 257 come into contact with the lower ends of slots 253 of the upright guide walls 245.

In the modified embodiment shown in FIGS. 8 to 13 the toner amount detector means 249 detects the amount of toner in the downstream portion of the housing 234 irrespective of the downstream-side toner conveying means 278 or, in other words without being influenced by the rotation of the downstream-side toner conveying means 278. Therefore no auxiliary rotary member is included in the downstream-side toner conveying means 278.

In the modified embodiment shown in FIGS. 8 to 13 the toner 246 exists in an amount greater than the predetermined amount in the downstream portion of the housing 234 when the detector 263 detects the ascend/descend member 251 (or more specifically, the upright wall 259 to be detected). while the toner 246 does not exist in an amount greater than the predetermined amount in the downstream portion of the housing 234 when the detector 263 does not detect the ascend/descend member 251. When the detector 263 detects the ascend/descend member 251 at the step n-4 in the flow chart shown in FIG. 6, therefore, the program returns to the step n-2. When the detector 263 does not detect the ascend/descend member 251, the program is shifted to the subroutine. Likewise, when the detector 263 detects the ascend/descend member 251 at the step m-6 in the flow chart shown in FIG. 7, the program proceeds to the step m-7, while when the detector 263 does not detect the ascend/descend member 251, the toner replenishment signal is given. In the modified embodiment shown in FIGS. 8 to 13 furthermore, detection of the toner amount detector means 249 is not influenced by the downstream-side toner conveying means 278 and the detector 263 does not detect the ascend/descend member 251 when toner 246 is not present in an amount greater than the predetermined amount in the downstream portion of the housing 234. Therefore, the steps m-7 and m-8 are not required in the flow chart of FIG. 7.

The constitution and actions of the modified embodiment shown in FIGS. 8 to 13 other than those mentioned above are the same as those of the constitution and actions of the embodiment explained with reference to FIGS. 1 to 7.

In the foregoing were closely described a specific embodiment and a modified embodiment by reference to the accompanying drawings. It should, however be noted that the present invention is in no way limited to the above embodiment and modified embodiment only, but can be modified or changed in a variety of other ways without departing from the scope of the present invention.

What we claim is:

1. A toner feeding device for an electrostatic latent image developer of an electrostatic image forming machine, said toner feeding device comprising:

a housing adapted to be mounted on the electrostatic latent image developer and to support a toner container disposed at the upstream end of said housing for discharging toner into said housing, toner sending means disposed at the downstream end of said housing for sending toner into the electrostatic latent image developer, toner conveying means for conveying the toner discharged from the toner container toward said toner sending means through said housing, drive means for driving said toner conveying means, toner amount detector means for detecting the amount of toner in the downstream portion of said housing, and control means for controlling the energization and de-energization of said drive means, wherein:

said toner conveying means includes at least one upstream-side toner conveying means disposed in the upstream portion of said housing and at least one downstream-side toner conveying means disposed in the downstream portion of said housing;

said drive means includes an upstream-side drive means for driving said upstream-side toner conveying means and a downstream-side drive means for driving said downstream-side toner conveying means; and said control means includes means for preventing energization of said upstream-side drive means when the amount of toner detected by said toner amount detector means is greater than a predetermined amount.

2. A toner feeding device according to claim 1, wherein said downstream-side drive means also drives said toner sending means so that said toner sending means and said downstream-side toner conveying means are driven when toner is to be sent from said housing.

3. A toner feeding device according to claim 1, wherein said control means includes means responsive to said toner amount detecting means detecting in an amount of toner less than or greater than a predetermined amount, for energizing or deenergizing said upstream-side drive means substantially simultaneously with said downstream-side drive means so that said upstream-side toner conveying means starts driving or stops driving substantially simultaneously with said downstream-side toner conveying means.

4. A toner feeding device according to claim 1, wherein said control means is responsive to the amount of toner detected by said toner amount detector means being less than the predetermined amount to generate a toner replenishment signal, indicating a shortage of toner in the toner container, irrespective of when said upstream-side drive means is energized for more than a predetermined period of time.

5. A toner feeding device according to claim 1, wherein said toner amount detector means comprises a swing plate swingably mounted in the downstream portion of said housing to contact the upper surface of toner in the downstream portion of said housing, and a detection device for detecting said swing plate.

6. A toner feeding device according to claim 5, wherein said detection device comprises a permanent magnet on said swing plate, and a reed switch on the outside of said housing for detecting said magnet.

7. A toner feeding device according to claim 5, wherein said downstream-side toner conveying means comprises a rotary member having a center axis of rotation and a conveying rod portion extending substantially in parallel with the center axis of rotation, said swing plate is disposed over said rotary member to be moved upwards by said conveying rod portion when said rotary member is rotated, and an auxiliary rotary member disposed in said downstream-side toner conveying means to raise said swing plate before said conveying rod portion of said rotary member moves said swing plate upwardly.

8. A toner feeding device according to claim 7, wherein said auxiliary rotary member includes an auxiliary rod portion extending substantially in parallel with said conveying rod portion radially inwardly of said conveying rod portion.

9. A toner feeding device according to claim 8, wherein said rotary member and said auxiliary rotary member are mounted on a common rotary shaft, said auxiliary member being angularly separated from said rotary member by a predetermined angle in the direction of rotation.

10. A toner feeding device according to claim 7, wherein said toner amount detector means detects the amount of toner in accordance with the lowermost position of said swing plate during a predetermined time interval when said downstream-side drive means is energized.

11. A toner feeding device according to claim 1, wherein said toner amount detector means comprises an ascend/descend member disposed in the downstream portion of said housing to ascend and descend in accordance with the amount of toner in the downstream portion of said housing, and a detector that detects said ascend/descend member.

12. A toner feeding device according to claim 11, wherein said toner amount detector further comprises separating means made of a soft sheet material disposed in the downstream portion of said housing to separate space in the housing interior into a lower toner space and an upper toner-free space, and wherein said ascend/descend member is brought into contact with the upper surface of the toner via said separation means.

13. A toner feeding device according to claim 11, wherein said detector is an optical detector having a light-emitting element and a light-receiving element.

14. A toner feeding device for an electrostatic latent image developer of an electrostatic image forming machine, said toner feeding device comprising:

a housing adapted to be mounted on the electrostatic latent image developer and to support a toner container at the upstream end of said housing to discharge toner into said housing, toner sending means disposed at the downstream end of said housing for sending toner into the electrostatic latent image developer, toner conveying means for conveying the toner discharged from the toner container toward said toner sending means through said housing, drive means for driving said toner conveying means, a toner amount detector including a swing plate swingably mounted in the downstream portion of said housing to contact the upper surface of toner in the downstream portion of said housing, and a detection device for detecting said swing plate, whereby said toner amount detector detects the amount of toner in the downstream portion of said housing, and control means for controlling the energization and de-energization of said drive means, wherein:

said toner conveying means includes at least one upstream-side toner conveying means disposed in the upstream portion of said housing and at least one downstream-side toner conveying means disposed in the downstream portion of said housing, said downstream-side toner conveying means includes a rotary member having a center axis of rotation and a conveying rod portion extending substantially in parallel with the center axis of rotation, said swing plate is disposed over said rotary member to be moved upwards by said conveying rod portion when said rotary member is rotated, and an auxiliary rotary member is disposed in said downstream-side toner conveying means to raise said swing plate before said conveying rod portion of said rotary member moves said swing plate upwardly; and said control means is responsive to said toner amount detector means detecting an amount of toner less than a predetermined amount to generate a toner replenishment signal, indicating a shortage of toner in the toner container, irrespective of when said upstream side toner conveying means is operated for more than a predetermined period of time.

15. A toner feeding device according to claim 14, wherein said drive means includes an upstream side drive means for driving said upstream side toner conveying means and a downstream-side drive means for driving said downstream side toner conveying means.

16. A toner feeding device according to claim 15, wherein said downstream-side drive means also drives said toner sending means so that said toner sending means and said downstream-side toner conveying means are driven when toner is sent from said housing.

17. A toner feeding device according to claim 14, wherein said detection device comprises a permanent magnet on said swing plate, and a reed switch outside said housing for detecting said magnet.

18. A toner feeding device according to claim 14, wherein said auxiliary rotary member includes an auxiliary rod portion extending substantially in parallel with said conveying rod portion radially inwardly of said conveying rod portion.

19. A toner feeding device according to claim 14, wherein said rotary member and said auxiliary rotary member are mounted on a common rotary shaft, said auxiliary rotary member being angularly separated from said rotary member by a predetermined angle in the direction of rotation.

20. A toner feeding device according to claim 14, wherein said toner amount detector means detects the amount of the toner in accordance with the lowermost position of said swing plate during a predetermined time interval when said downstream-side drive means is energized.

* * * * *